US006270371B1

(12) United States Patent
Doushita

(10) Patent No.: US 6,270,371 B1
(45) Date of Patent: Aug. 7, 2001

(54) CONNECTOR CONNECTING STRUCTURE

(75) Inventor: Kenichi Doushita, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/298,990

(22) Filed: Apr. 26, 1999

(30) Foreign Application Priority Data

Apr. 28, 1998 (JP) ..... 10-119319

(51) Int. Cl.[7] ..... H01R 13/64
(52) U.S. Cl. ..... 439/376
(58) Field of Search ..... 439/342, 376

(56) References Cited

U.S. PATENT DOCUMENTS

| | | | | |
|---|---|---|---|---|
| 4,103,983 | * | 8/1978 | Morrison et al. | 439/298 |
| 4,418,975 | * | 12/1983 | O'Keefe, II | 439/344 |
| 5,156,558 | * | 10/1992 | Belanger, Jr. | 439/376 |
| 5,586,901 | * | 12/1996 | Muta | 439/342 |
| 5,713,754 | * | 2/1998 | Samejima et al. | 439/374 |
| 5,816,839 | * | 10/1998 | Muta | 439/342 |
| 6,000,959 | * | 12/1999 | Curtindale et al. | 439/247 |
| 6,045,400 | * | 4/2000 | Detter | 439/532 |
| 6,053,758 | * | 4/2000 | Kato et al. | 439/364 |
| 6,135,801 | * | 10/2000 | Helot et al. | 439/341 |

* cited by examiner

*Primary Examiner*—Neil Abrams
*Assistant Examiner*—J. F. Duverne

(74) *Attorney, Agent, or Firm*—Armstrong, Westerman, Hattori, McLeland, & Naughton, LLP

(57) ABSTRACT

A connector connecting structure applied to a motor vehicle is provided, which includes: a first connector having first wire connected terminals; a second connector also having second wire connected terminals and to be coupled with the first connector for making an electric connection; a first mounting portion for arranging the first connector; a second mounting portion for arranging the second connector; a first connector frame to be fixed to the first mounting portion and to support one end of the first connector so as to project the other end thereof; and a second connector frame to be fixed to the second mounting portion and including: a top-wall opening formed in a coupling direction of the first and second connectors for permitting the first connector to go through; a side-wall opening formed in a coupling operation direction of the first and second mounting portions; a slide plane, tapered or in a curve, for shifting the other end of the first connector toward the top-wall opening between the side-wall opening and the top-wall opening on coupling operation between the first and second connectors; and a connector accommodating portion provided with a receiving opening on the slide plane and directed in the coupling direction so as to receive the second connector, wherein the first and second connectors are connected with each other through the receiving opening so as to electrically connect the first and second wire connected terminals by bending at least one of the first and second mounting portions by means of sliding the other end of the first connector on the slide plane when the first and second connectors are coupled.

7 Claims, 8 Drawing Sheets

CONNECTOR CONNECTING STRUCTURE

BACKGROUND OF THE INVENTION

1. Field of the Invention

The present invention generally relates to a connector connecting structure and more particularly, to a connector connecting structure which is superior in connecting workability of connectors and in positioning of connectors at coupling operation thereof.

2. Description of the Related Art

FIG. 8 is a perspective view showing a conventional connector connecting structure.

This connector connection structure consists of a female connector 2 fixed to an auxiliary device 1 and a male connector 4 provisionally supported by a vehicle body 3. When the auxiliary device 1 is shifted in a coupling operation direction (an arrow W direction) orthogonally to a connector coupling direction (an arrow V direction), the female connector 2 engages the male connector 4 through a slider 5.

The female connector 2 is fixed to the auxiliary device 1, and a plurality of male electric terminals (not shown) each connected to an electric wire 7 are accommodated in a housing 6 made of synthetic resin. And, a through hole 9 for the slider 5 put through the auxiliary device 1 is provided on one side wall 8 of the housing 6, and a through hole 11 to be similar on the other side wall 10 facing the side wall 8 is provided. Further, a notched opening 12 opens diagonally from a middle portion of the other side wall 10 to a front edge of the housing 6, facing the male connector 4.

A pair of supporting walls 13 are provided on the vehicle body 3, and an engaging opening 14 for provisional support of the male connector 4 is formed on each of the supporting walls 13.

As shown in FIG. 8 and FIG. 9, the male connector 4 is provided with an elastic locking arm 18 on both of side walls 16 of a housing 15 made of synthetic resin. The elastic locking arm 18 has an engaging projection 17 corresponding to the supporting wall 13. A plurality of female electric terminals (not shown) connected to each of the electric wires 7 are accommodated in the housing 15. And, in the front edge center of the housing 15, a through groove 19 for the slider 5 is formed from the one side wall 16 to the other side wall 16, and a sliding engagement portion 20 in a rectangle pillar shape is provided on the through groove 19 centrally. Further, on the one side wall 16, a pair, top and bottom, of positioning projections 21 in a rectangular pillar shape are formed.

The slider 5 consists of a horizontal sliding plate 22 and an operating portion 23, and an entrance 24 for the sliding engagement portion 20 of the male connector 4 and a cam groove 25 curving quadratically are formed on the sliding plate 22.

As shown in FIG. 11, the female connector 2 initially engages the male connector 4 through the notched opening 12 by provisionally supporting the male connector 4 to the vehicle body 3 through the elastic locking arm 18 and then shifting the female connector 2 along with the auxiliary device 1 in the coupling operation direction (an arrow W direction) as shown in FIG. 10. Subsequently, on insertion of the slider 5 in an arrow X direction, the sliding engagement portion 20 (FIG. 10) is introduced into the cam groove 25 (FIG. 10) through the entrance 24 (FIG. 10). As is shown in FIG. 12, the male connector 4 is pulled into the female connector 2 in the connector coupling direction (an arrow V direction), thereby connecting the male and female terminals (not shown) and also completing connector coupling. At the same time, engagement of the elastic locking arm 18 is released.

With respect to the above conventional connector connecting structure, there are the following drawbacks.

Firstly, on connection of connectors, since pushing operation of the slider is required, work step increases, which makes assembling process rather complex. And, this lowers an efficiency of assembly work of members having the connectors.

Besides, a fairly severe assembly allowance of the auxiliary device 1 and the vehicle body 3 is required for inserting the slider 5 in the through groove 19. Accordingly, since the sliding engagement portion 20 sometimes does not engage the cam groove 25, connector connection would not be performed surely. And, damage or breakage of the terminals or the housings 6,15 would occur due to interference between them. Also, in case that the male connector 4 has been reverse attached to the vehicle body 3, damage or breakage would occur.

Even if position precision is going to be raised in the present situation, in case of location where a lot of members are related to, the above problems cannot be readily canceled because dimension tolerance of each member affects each other.

SUMMARY OF THE INVENTION

In view of the foregoing, an object of the present invention is to provide a connector connecting structure which is superior in connecting workability of connectors and in positioning of connectors at coupling operation thereof.

In order to achieve the above-described object, as a first aspect of the present invention, a connector connecting structure consists of: a first connector having first wire connected terminals; a second connector also having second wire connected terminals and to be coupled with the first connector for making an electric connection; a first mounting portion for arranging the first connector; a second mounting portion for arranging the second connector; a first connector frame to be fixed to the first mounting portion and to support one end of the first connector so as to project the other end thereof; and a second connector frame to be fixed to the second mounting portion and including: a top-wall opening formed in a coupling direction of the first and second connectors for permitting the first connector to go through; a side-wall opening formed in a coupling operation direction of the first and second mounting portions; a slide plane, tapered or in a curve, for shifting the other end of the first connector toward the top-wall opening between the side-wall opening and the top-wall opening on coupling operation between the first and second connectors; and a connector accommodating portion provided with a receiving opening on the slide plane and directed in the coupling direction so as to receive the second connector, wherein the first and second connectors are connected with each other through the receiving opening so as to electrically connect the first and second wire connected terminals by bending at least one of the first and second mounting portions by means of sliding the other end of the first connector on the slide plane when the first and second connectors are coupled.

According to the above-described structure, since engagement of the first connector and the second connector can complete simultaneously with only an operation of the second mounting portion or otherwise of the first mounting portion, the conventionally required pushing-in operation of the slider is not required any more, thereby very simplifying connector connecting work and remarkably improving workability.

As a second aspect of the present invention, in the structure with the above first aspect, a shape of a coupling-side end of the second connector is similar to the receiving opening.

According to the above-described structure, since a shape of the coupling-side end of the second connector is similar to the receiving opening, an connecting end of the first connector can smoothly approach the second connector at the coupling operation, thereby improving workability. And, since the slide plane is formed to be tapered or in a curve, the coupling-side end does not agree with the receiving opening in case that the second connector is reversely attached, a worker can be noticed of an error of attaching direction of the second connector, thereby surely preventing damage or breakage of the connectors.

As a third aspect of the present invention, in the structure with the above first aspect, the connector connecting structure further includes a guide plane, tapered or in a curve, is formed at a corner of the side-wall opening for guiding the first connector.

According to the above-described structure, since connection of the connectors an be surely done even in case that the first connector and the second connector are not aligned in a line, therefore, the connector connection work can be performed stable not depending on a worker. Also, since the first connector and the first connector frame are guided to the slide plane surely, their damage or breakage can be prevented.

As a fourth aspect of the present invention, in the structure with the above first aspect, the first mounting portion is provided with a concave avoiding an interference with the second connector frame or with a convex capable of moving between the side-wall opening and the top-wall opening for attaching the first connector frame thereto.

According to the above-described structure, since the concave or the convex is formed on the first mounting portion, this guides the second connector frame. In case the concave is formed, this protects both of the connector frames as a cover.

As a fifth aspect of the present invention, in the structure with the above first aspect, a pair of sets of the first connector attached to the first mounting portion through the first connector frame and the second connector attached to the second mounting portion through the second connector frame are arranged symmetrically so that coupling operation between the first connectors and the second connectors are simultaneously executed.

According to the above-described structure, connection work of the connectors can be performed effectively also with the same effects as the above-described ones.

As a sixth aspect of the present invention, in the structure with the above first aspect, the first mounting portion and the second mounting portion are provided on a vehicle such as a automobile.

According to the above-described structure, connection work of the connectors equipped on a vehicle can be performed easily and stable with the coupling operation described hereinbefore.

As a seventh aspect of the present invention, in the structure with the above sixth aspect, the second mounting portion is provided on a portion of a parts such as a console of the vehicle and the first mounting portion is provided on a panel facing the portion of the parts.

The above and other objects and features of the present invention will become more apparent from the following description taken in conjunction with the accompanying drawings.

DESCRIPTION OF THE PREFERRED EMBODIMENT

An embodiment of the present invention will now be described in further detail with reference to the accompanying drawings.

Figure 1:
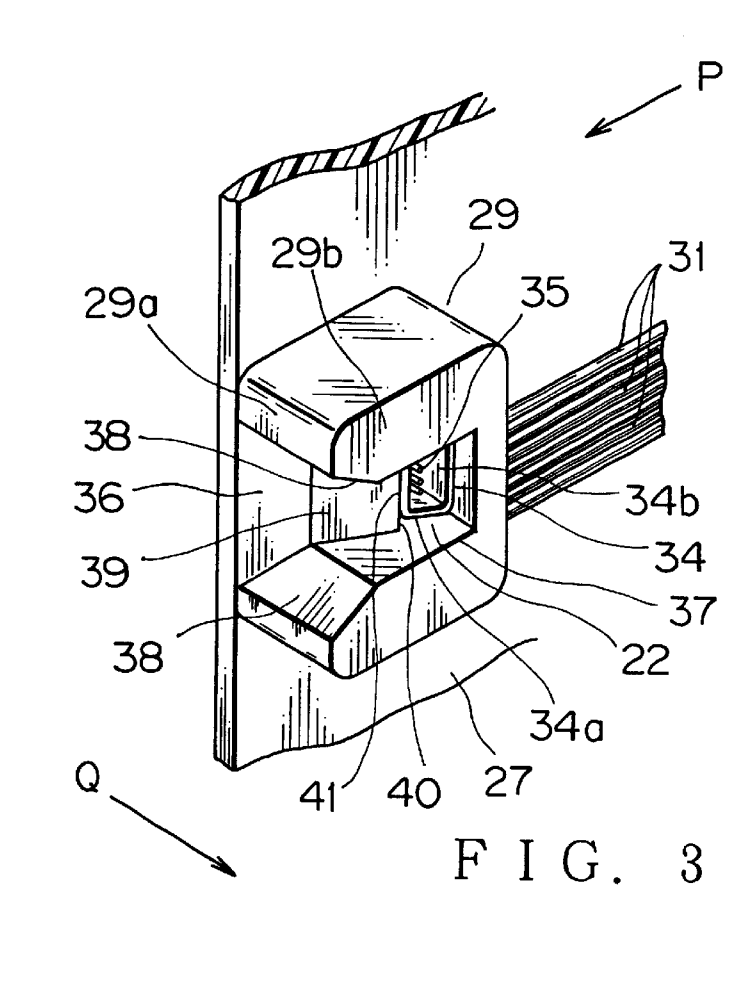
FIG. 1 is a perspective view showing a basic structure of an embodiment of a connector connecting structure according to the present invention.

FIG. 1 is a perspective view showing a basic structure of an embodiment of a connector connecting structure according to the present invention.

As is shown in FIG. 1, the connector connecting structure according to the present invention includes a first connector 21, a second connector 22, a first mounting portion A for the first connector 21, a second mounting portion B for the second connector 22, a first connector frame 28, and a second connector frame 29 in order to make electric connection between the connectors 21,22. The first connector 21 is mounted on the first connector frame 28 which is integrally formed with or fixed to the first mounting portion A.

And, the second connector 22 is mounted on the second connector frame 29 which is integrally formed with or fixed to the second mounting portion B. The first connector frame 28 supports a wire led-out portion, from which wires from wire connected terminals 33 are led out, of the first connector 21 so that the first connector 21 projects therefrom. A side-wall opening 36 and a top-wall opening 37 both for the first connector 21 are formed on the second connector frame 29, and also the second connector frame 29 has a slide plane 39 for the first connector 21 and an accommodating portion 40 for the second connector 22.

The side-wall opening 36 faces in a coupling direction Q of the first connector 21 and the second connector 22, and the top-wall opening 37 faces in a coupling operation direction P of the first mounting portion A and the second mounting portion B. The slide plane 39 is formed in tapered or in a curve for shifting the opposite end of the wire led-out portion of first connector 21 toward the top-wall opening 37 between the side-wall opening 36 and the top-wall opening 37 on coupling operation between the first and second connectors. And, the accommodating portion 40 is formed in the coupling direction Q from a receiving opening 41 continuing to the slide plane 39.

Figure 3:
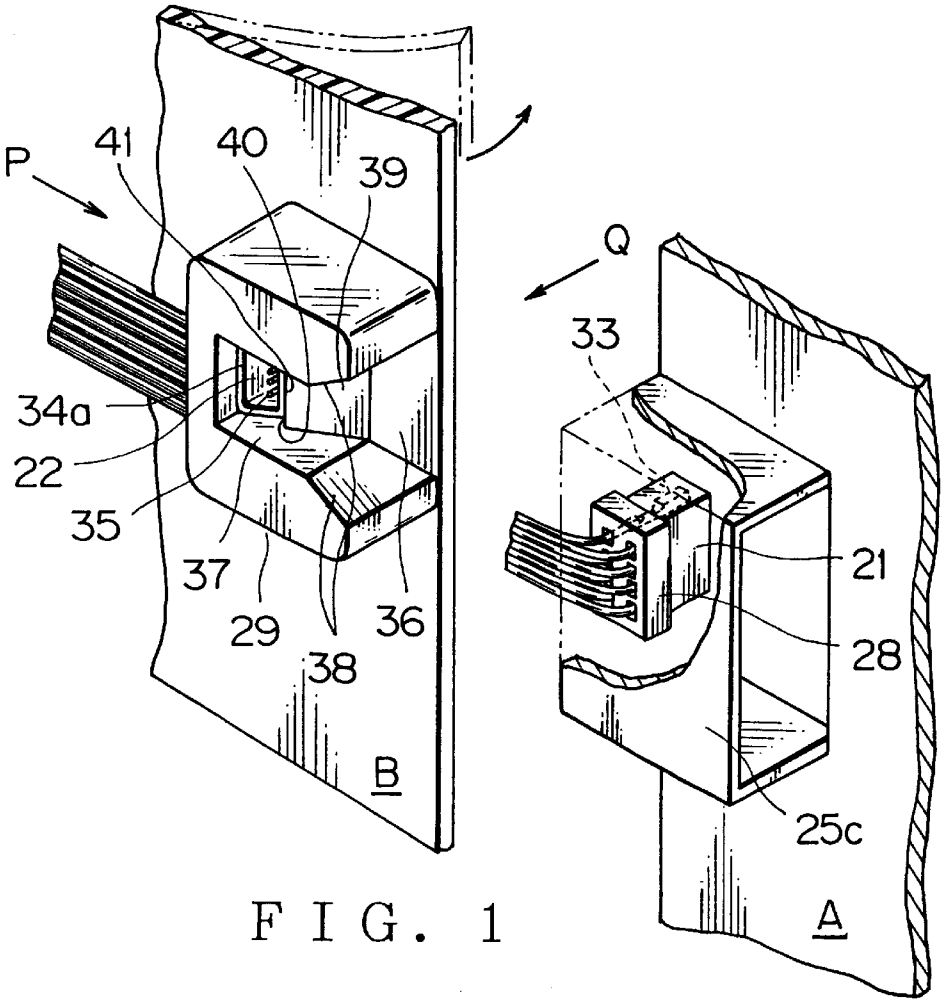
FIG. 3 is a perspective view, taken from an arrow A of FIG. 2, of a female connector and a second connector frame.
Figure 2:
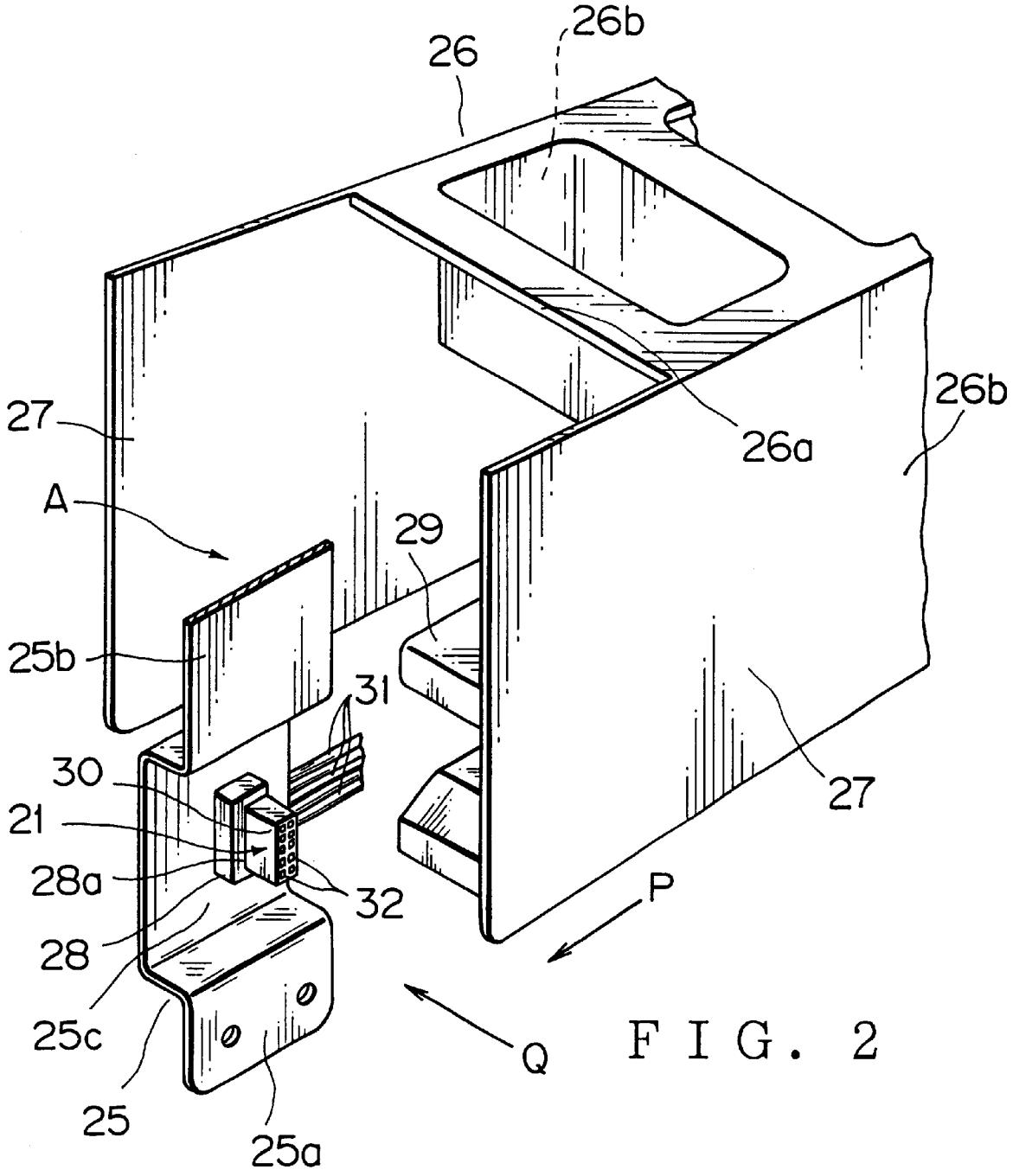
FIG. 2 is a perspective view showing a state of the connector connecting structure of FIG. 1 applied to a console of a motor vehicle.

FIG. 2 is a perspective view showing a state of the connector connecting structure of FIG. 1 applied to a console 26 of a motor vehicle (not shown). And, FIG. 3 is a perspective view, taken from an arrow A of FIG. 2, of a female connector 21 and the second connector frame 29. Also, FIG. 4 to FIG. 7 are perspective views showing installation process of the console 26 of FIG. 2 and connection process of connectors 21,22.

The connector connecting structure applied to a motor vehicle is described hereinafter, while referring to FIG. 2 and FIG. 3.

Besides the male connector 21 (corresponding to the first connector 21 in FIG. 1) and the female connector 22 (corresponding to the second connector 21 in FIG. 1), this connector connecting structure includes a panel 25 (corresponding to the first mounting portion A in FIG. 1) provided below a central unit accommodating portion 24 (FIG. 4) of an instrument panel 23 (FIG. 4) for fixing the instrument panel 23, a panel attaching plate 27 (corresponding to the second mounting portion B in FIG. 1) provided on the end of the console 26 in a box-like shape, the first connector frame 28, and the second connector frame 29. In this structure, simultaneously with assembly of the console 26 in a coupling operation direction shown with an arrow P, connector connection in a coupling direction shown with an arrow Q completes.

The male connector 21 consists of a rectangular connector housing 30 and a plurality of female electric terminals 33 (refer to FIGS. 5 to 7) connected to electric wires 31 and to be accommodated in each of terminal accommodating portions 32 arranged in the connector housing 30 in two layers.

On the other hand, the female connector 22 consists of a connector housing 34 having a case portion 34*b* with a rectangular section and having a front end portion 34*a* (i.e. a coupling-side end) with the same inclination as of a slide plane 39 (described later) and a plurality of male electric terminals 35 connected to the electric wires 31 and projecting from the case portion 34*b*. The front end portion 34*a* agrees with the receiving opening 41 in case accommodated in the accommodating portion 40.

The panel 25 is made of a metal plate, and a first end 25*a* is fixed to a vehicle body (not shown) and a second end 25*b* side is attached to the instrument panel 23. And, in an intermediate portion of the panel 25, a concave 25*c* is bendingly formed by press-work, and the first connector frame 28 made of synthetic resin is attached on a bottom wall of the concave 25*c* by a known fixation means such as screwing.

The concave 25*c* plays a role of a guide for the second connector frame 29 and protects the first and second connector frames 28,29 after assembly of the console 26. Also, a convex may be formed, replacing the concave 25*c*.

The first connector frame 28 is a member formed in a rectangular column-like shape to fix the male connector 21, has an accommodating portion 28*a* to receive the wire led-out portion (not shown) side of the connector housing 30, and also has openings (not shown) to put through a plurality of electric wires 31 on a depths-wall (not shown) of the accommodating portion 28*a*.

The panel attaching plate 27 is formed at the front end portion 26*a* of the console 26 by extending the side wall 26*b* and has a resilience. On one of the panel attaching plates 27, the second connector frame 29 made of synthetic resin is formed integrally or fixed by a known fixation means such as a screw. (In the present embodiment, nothing is attached to the other panel attaching plate 27.)

As shown in FIG. 3, the second connector frame 29 is a member formed in a substantially cube and is bigger than the first connector frame 28. A side-wall opening 36 is formed on a side wall 29*a* of the second connector frame 29 in the coupling operation direction P, and a top-wall opening 37 communicating with the side-wall opening 36 is formed on a top wall 29*b* in the coupling direction Q. And, at both edges of the side-wall opening 36, a guide plane 38, taper or in a curve, is formed, and a slide plane 39 rising from the end of the guide plane 38 toward the top wall 29*b* is formed. And the accommodating portion 40 for the female connector 22 is provided on the slide plane 39 in the coupling direction Q, and the receiving opening 41 is formed along the slide plane 39 at the end of the accommodating portion 40.

In the present embodiment, though the accommodating portion 40 is formed at the upper end portion of the slide plane 39, the accommodating portion 40 may be provided at a portion a little lower than the upper end portion. And, the slide plane 39 needs, at least, a height equal to that of the case portion 34*b*, and a curved slant may be applied to the slide plane 39 instead of the tapered slant.

Figure 4:
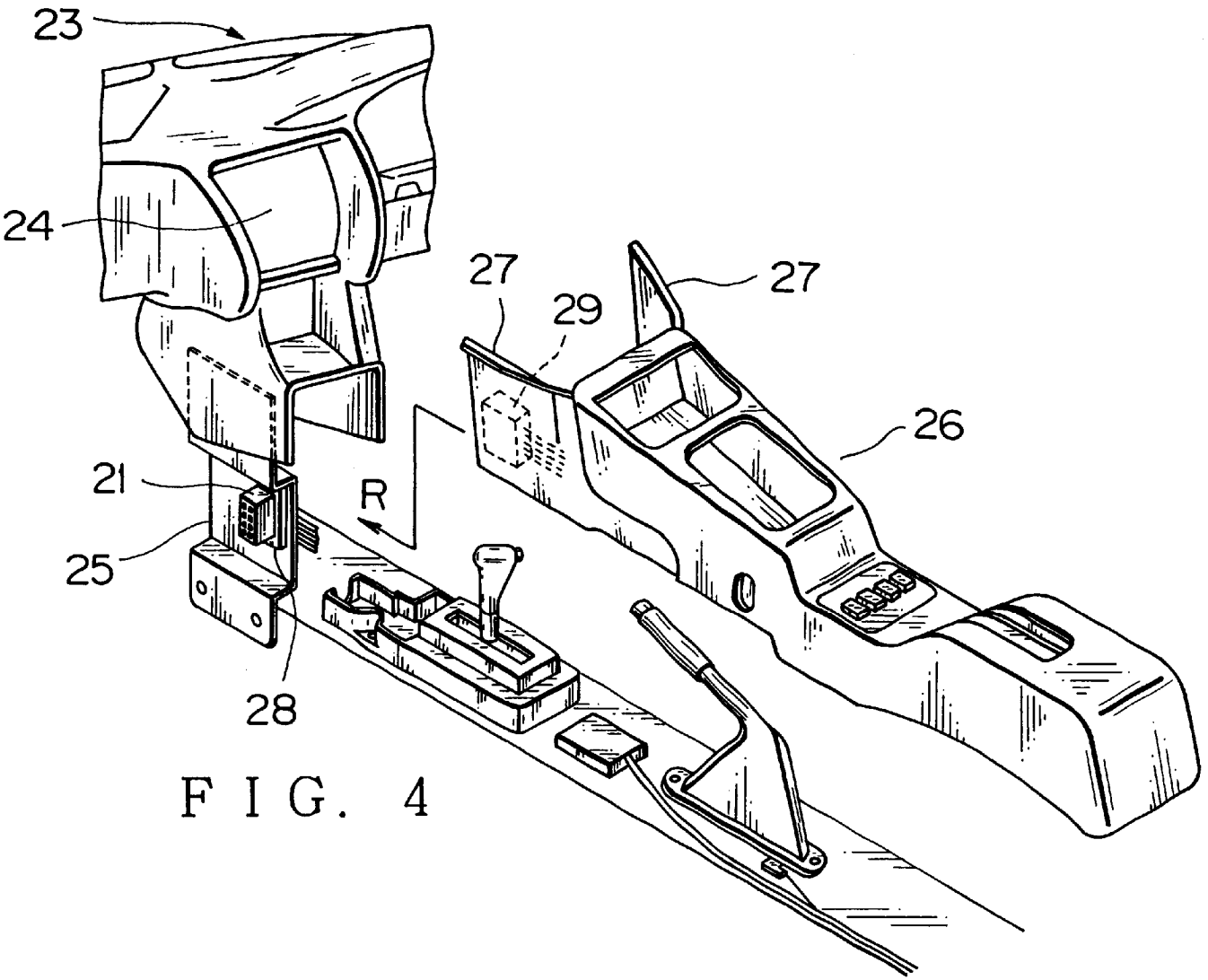
FIG. 4 is a perspective view showing installation process of the console of FIG. 2 and connection process of the connectors.

Here, description of the instrument panel 23, the central unit accommodating portion 24, and the console 26 each shown in FIG. 4 is omitted since they have known structures.

Figure 5:
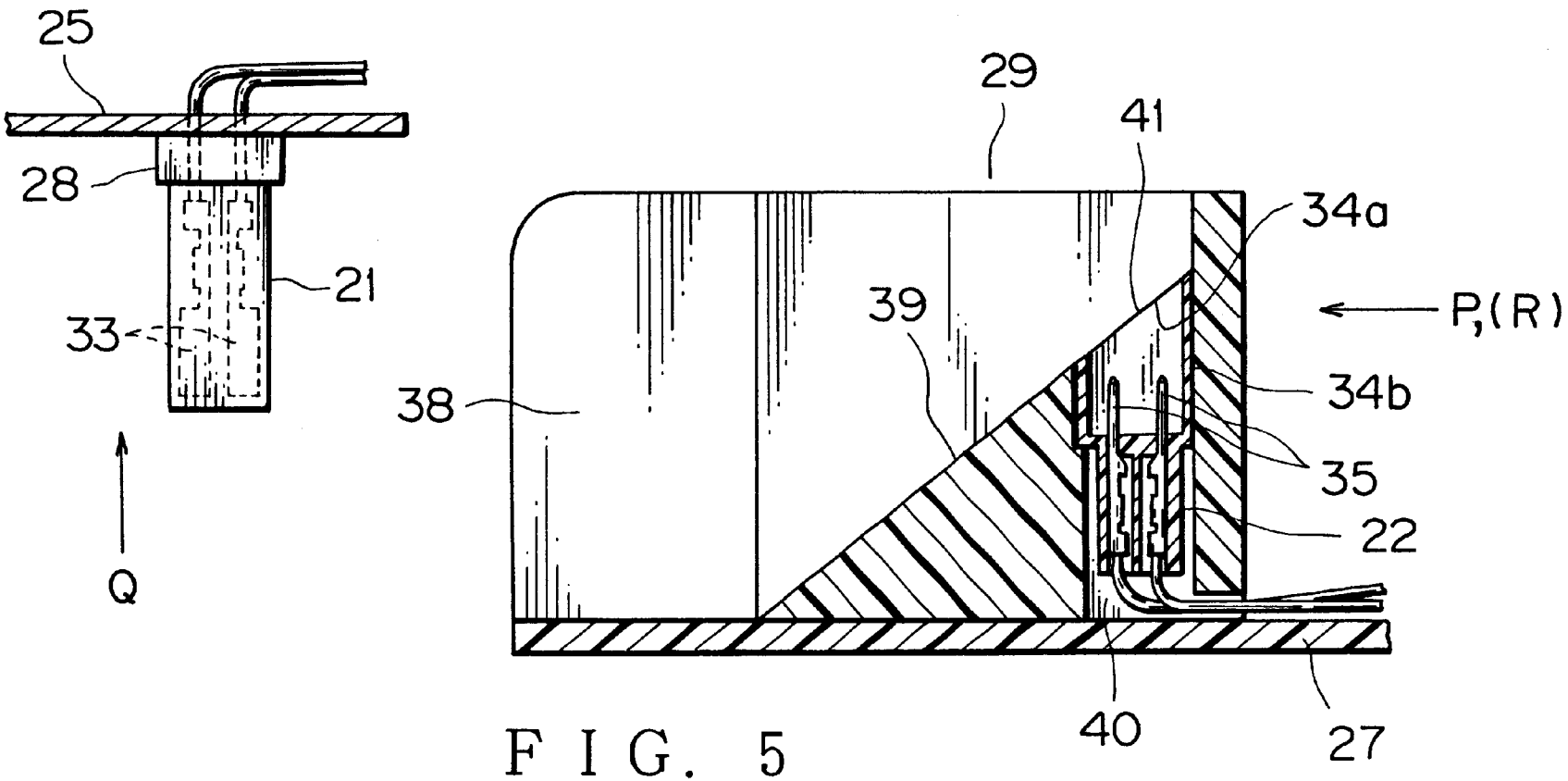
FIG. 5 is a longitudinal sectional view showing an initial connection state of the connectors.

In the above structure, referring to FIG. 4 to FIG. 7, the installation process of the console 26 and the connection process of the connectors 21,22 are described hereinafter. Here, FIG. 5 to FIG. 7 show the connection process of the connectors 21,22 sectionally.

In FIG. 4, the male connector 21 has been attached to the panel 25 through the first connector frame 28, and the female connector 22 has been attached to the panel attaching plate 27 through the second connector frame 29. And, the front end portion 34*a* of the female connector 22 has been adjusted to the receiving opening 41.

First of all, the console 26 is installed forward the instrument panel 23 in an arrow R direction (i.e. a coupling operation direction corresponding to the coupling operation direction P), which is a starting state of the coupling operation. As is shown in FIG. 5, the male connector 21 and the female connector 22 are still mutually remote state.

Figure 6:
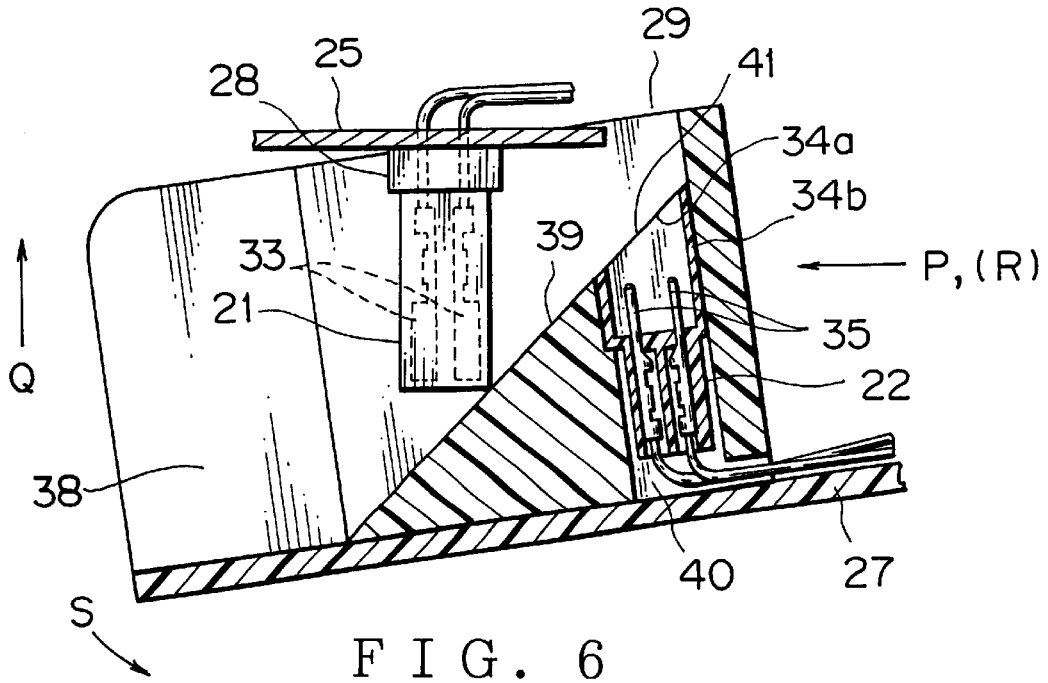
FIG. 6 is a longitudinal sectional view showing a state that the male connector is sliding on a slide plane after the state of FIG. 5, wherein the coupling operation of the connectors has further proceeded.
Figure 7:
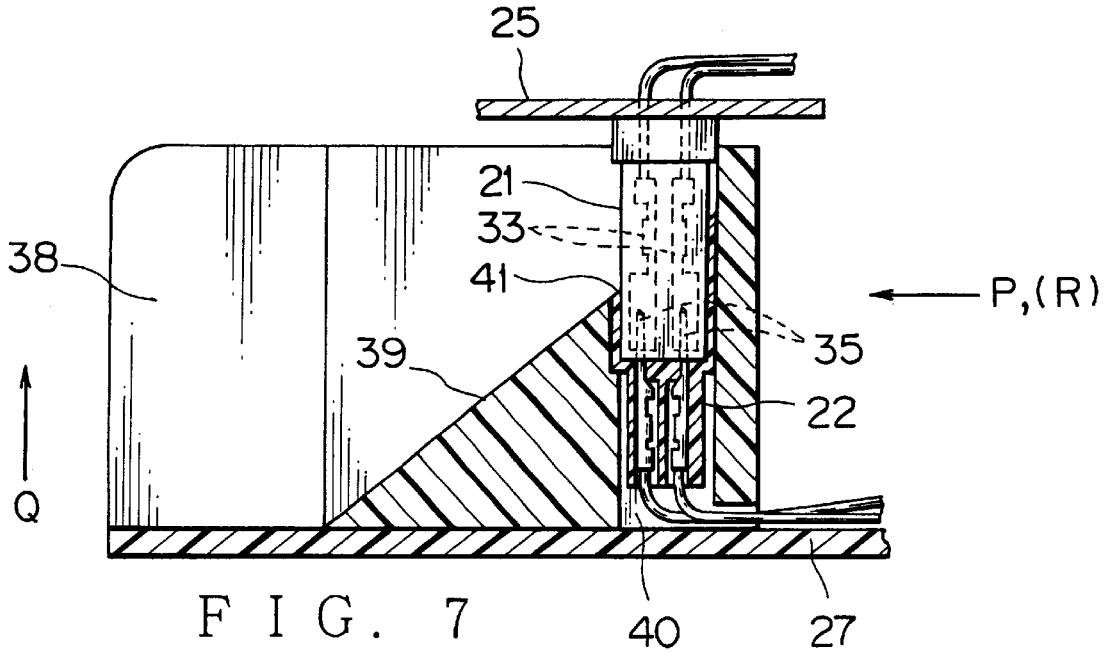
FIG. 7 is a longitudinal sectional view showing a state that the male and the female connectors are coupled with each other after the state of FIG. 6, wherein the coupling operation of the connectors has further proceeded.
Figure 8:
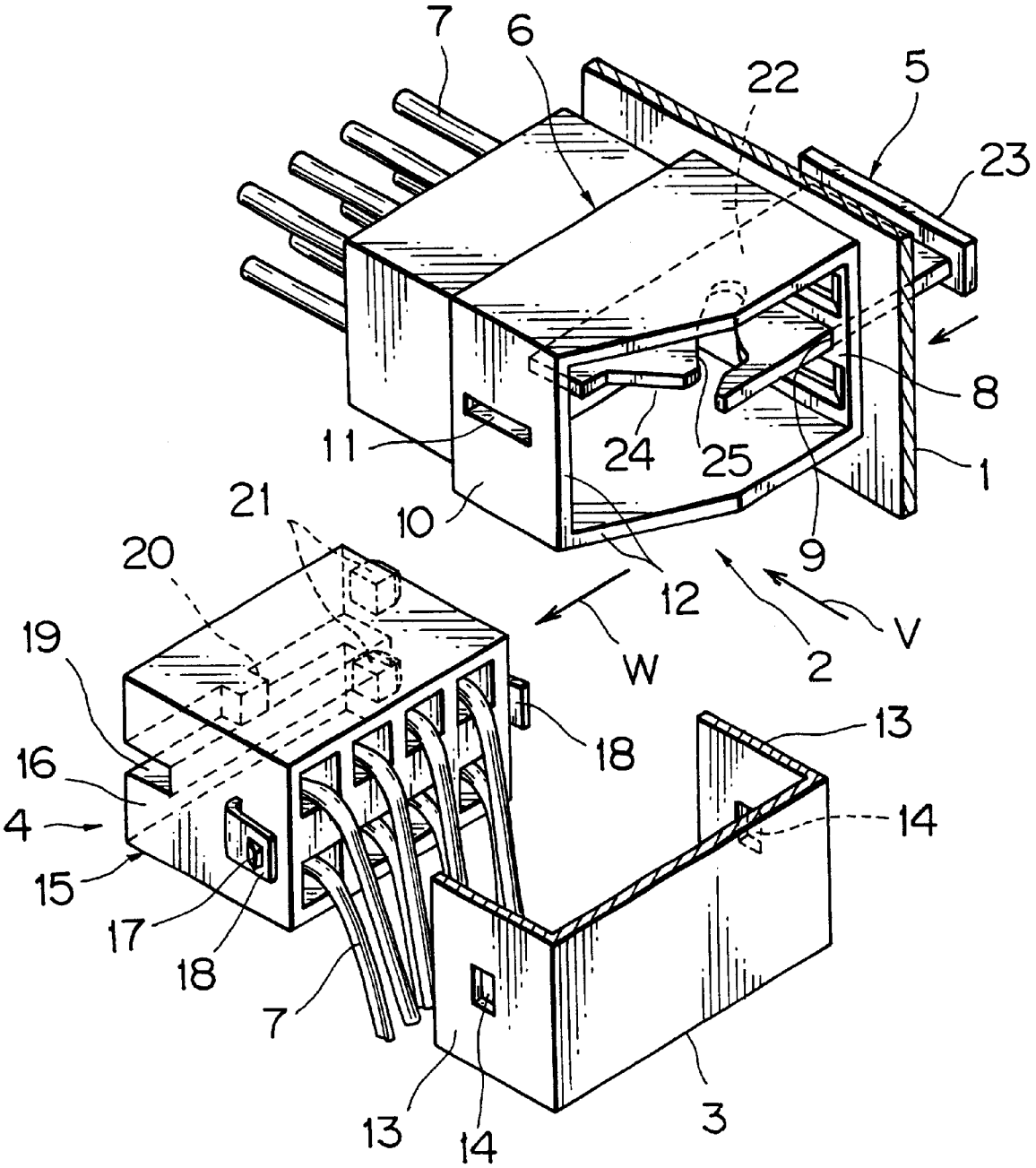
FIG. 8 is a perspective view showing a conventional connector connecting structure.
Figure 9:
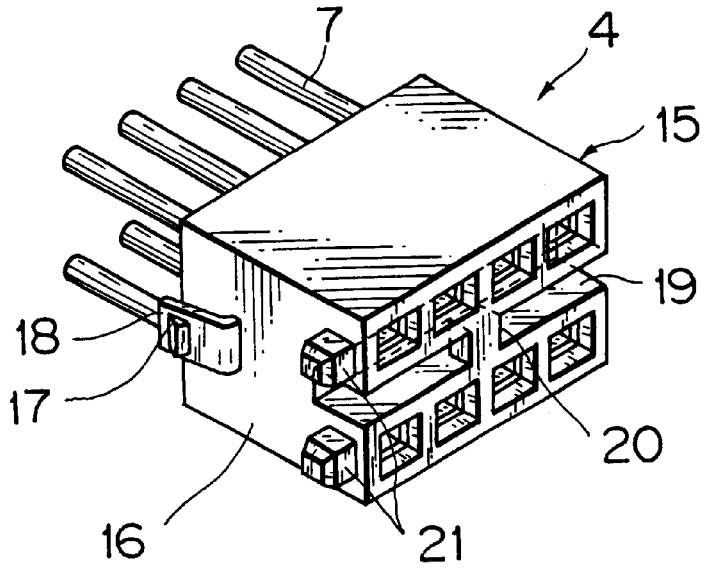
FIG. 9 is a perspective view of the male connector of FIG. 8.
Figure 10:
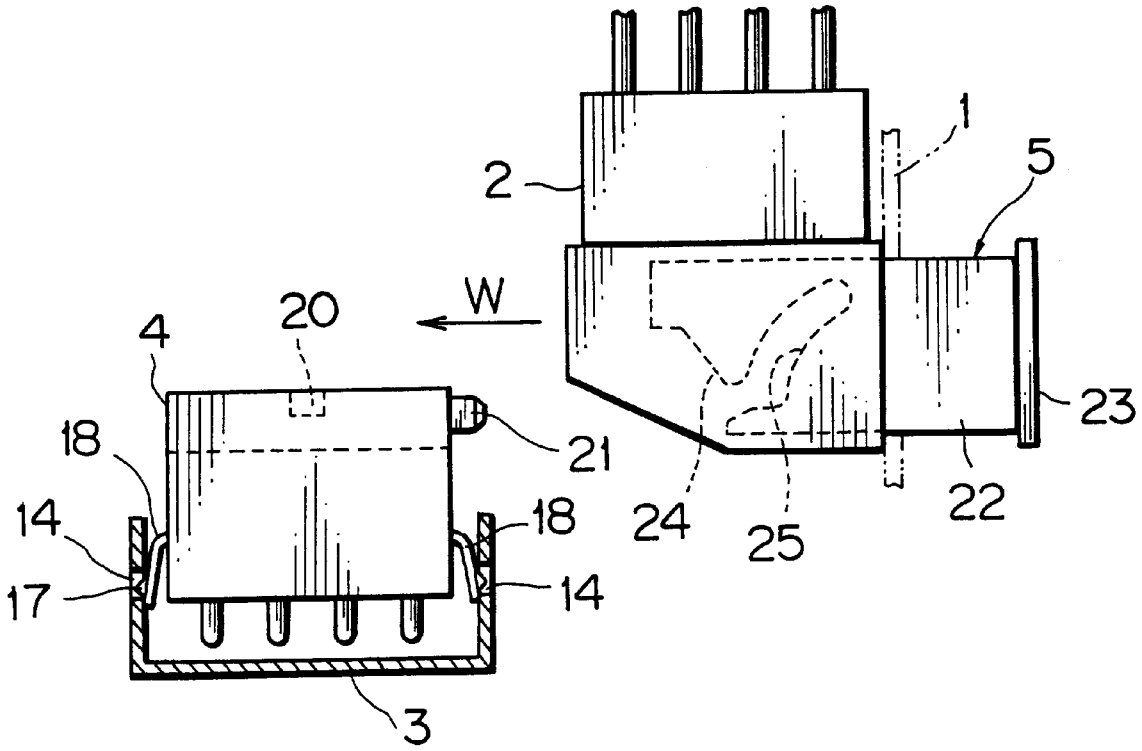
FIG. 10 is a side view showing an initial state of connection process of the connectors of FIG. 8.
Figure 11:
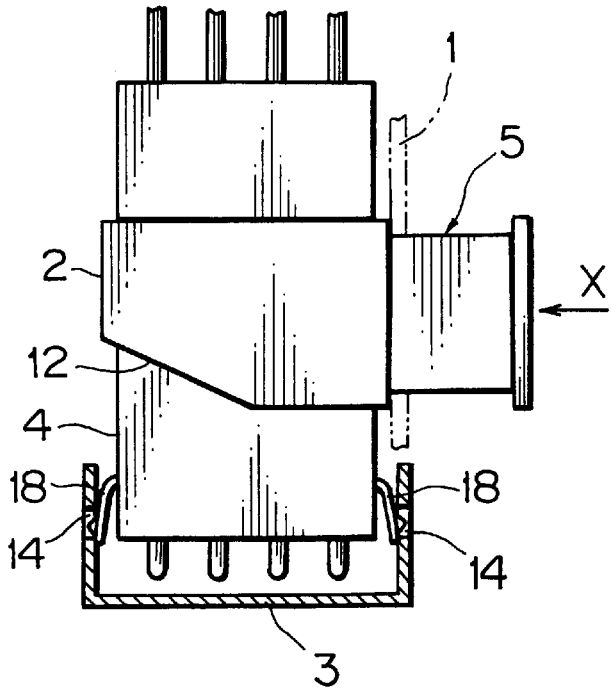
FIG. 11 is a longitudinal sectional view showing a state that the male and the female connectors are initially coupled with each other after the state of FIG. 10, wherein the coupling operation of the connectors has further proceeded.
Figure 12:
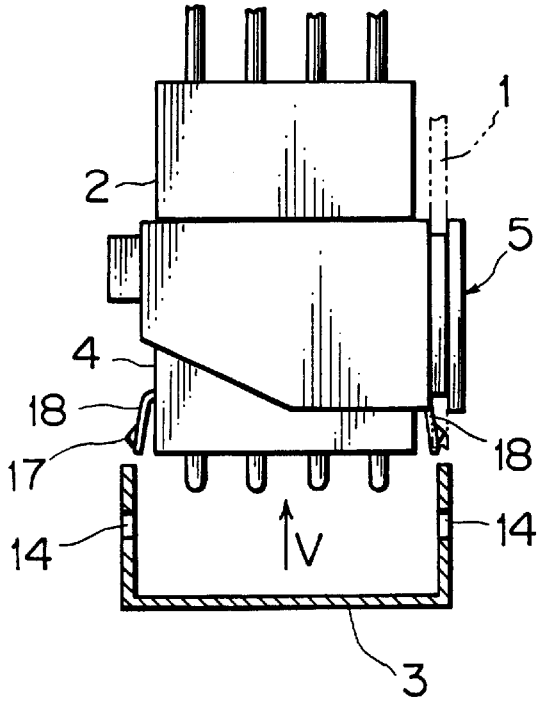
FIG. 12 is a longitudinal sectional view showing a state that the male and the female connectors are completely coupled with each other by means of pushing in the slider after the state of FIG. 11.

Following the above, the panel attaching plate 27 comes over the panel 25, and as shown in FIG. 6 the front end portion of the male connector 21 slides on the guide plane 38 of second connector frame 29. If the male connector 21 is not located in the center of the coupling operation direction P (R), the coupling operation direction P (R) is corrected by abutment of the guide plane 38 against the male connector 21 or against the first connector frame 28, and then the slide plane 39 is led to male connector 21 correctly.

Afterwards, while the male connector 21 slides on the slide plane 39, the panel attaching plate 27 gradually bends outwardly in an arrow S direction (reversal of the coupling direction Q) since the panel 25 is fixed to the vehicle body (not shown) and the instrument panel 23.

And, shown in FIG. 7, the panel attaching plate 27 comes back in the coupling direction Q by resilience when the front end portion of the male connector 21 gets over the receiving opening 41 and arrives at the case portion 34*b* of the female connector 22. With this, the male connector 21 and the female connector 22 couples at a stretch. And simultaneously, a plurality of male electric terminals 35 and of female electric terminals 33 are connected, and thereby serial installation process and connector connection complete.

As is described above while referring to referring to FIG. 4 to FIG. 7, coupling and connection of the male connector 21 and the female connector 22 can be performed simultaneously with the installation of the console 26.

And otherwise, for example, a pair of both of the structure of the panel 25 and the structure of the panel attaching plate 27 may be provided so as to connect two couples of connectors simultaneously.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A connector connecting structure comprising:

a first connector having first wire connected terminals;

a second connector having second wire connected terminals to be coupled with said first connector for making an electric connection;

a first mounting portion on which said first connector is mounted;

a second mounting portion on which said second connector is mounted;

a first connector frame, on said first connector, fixed to said first mounting portion and supporting one end of said first connector so as to project the other end thereof; and a second connector frame fixed to said second mounting portion and including:

a top-wall opening formed in a coupling direction of said first and second connectors for permitting movement of said first connector with respect to said second connector;

a side-wall opening formed in a coupling operation direction of said first and second mounting portions;

an inclined slide plane, tapered or in a curve, for engaging said other end of said first connector and shifting it toward said top-wall opening upon relative movement between said first mounting portion and said second mounting portion during coupling operation between said first and second connectors; and a connector accommodating portion provided with a receiving opening disposed on said slide plane and directed in said coupling direction so as to receive said second connector, wherein said first and second connectors are resiliently biased into connected relation with each other through said receiving opening so as to electrically connect said first and second wire connected terminals by resiliently bending at least one of said first and second mounting portions in said coupling direction by means of sliding said other end of said first connector on said slide plane when said first and second mounting portions are moved in horizontal directions perpendicular to said coupling direction with respect to each other during assembly thereof.

2. The connector connecting structure according to claim 1, wherein a coupling-side end of said second connector has a shape similar to that of said receiving opening.

3. The connector connecting structure according to claim 1, further comprising an inclined guide plane, tapered or in a curve, formed at a corner of said side-wall opening for guiding said first connector.

4. The connector connecting structure according to claim 1, wherein said first mounting portion is provided with a concave surface avoiding an interference with said second connector frame for attaching said first connector frame thereto.

5. The connector connecting structure according to claim 1, wherein a pair of sets of said first connector attached to said first mounting portion through said first connector frame and said second connector attached to said second mounting portion through said second connector frame are arranged so that coupling operation between said first connectors and said second connectors are simultaneously executed.

6. The connector connecting structure according to claim 1, wherein said first mounting portion and said second mounting portion are provided on an automotive vehicle.

7. The connector connecting structure according to claim 6, wherein said second mounting portion is provided on a console of said vehicle and said first mounting portion is provided on a panel facing said console.

* * * * *